US009198482B2

(12) United States Patent
Fietsam

(10) Patent No.: US 9,198,482 B2
(45) Date of Patent: Dec. 1, 2015

(54) DEVICE AND METHOD FOR SECURING A COVER TO A STRUCTURE

(71) Applicant: Scott David Fietsam, Algonquin, IL (US)

(72) Inventor: Scott David Fietsam, Algonquin, IL (US)

( * ) Notice: Subject to any disclaimer, the term of this patent is extended or adjusted under 35 U.S.C. 154(b) by 58 days.

(21) Appl. No.: 13/736,266

(22) Filed: Jan. 8, 2013

(65) Prior Publication Data

US 2014/0076228 A1 Mar. 20, 2014

Related U.S. Application Data

(60) Provisional application No. 61/744,060, filed on Sep. 18, 2012.

(51) Int. Cl.

| | |
|---|---|
| ***B63B 17/00*** | (2006.01) |
| ***A44B 17/00*** | (2006.01) |
| ***B63B 17/02*** | (2006.01) |

(52) U.S. Cl.

CPC ..... *A44B 17/0064* (2013.01); *A44B 17/00* (2013.01); *B63B 17/02* (2013.01); *A44D 2203/00* (2013.01); *Y10T 24/32* (2015.01); *Y10T 29/49826* (2015.01)

(58) Field of Classification Search

CPC ..... B63B 17/00; B63B 22/14; B63B 22/10; B63B 17/02; B63B 2017/026; B63B 59/02; B63B 59/045; H01F 7/0263; H01F 7/0252; A44D 2203/00; A41F 1/002; F16B 2001/0035; A44B 17/0064; A44B 17/00; Y10T 29/49826; Y10T 24/32

USPC ..... 114/361; 24/303; 248/206.5, 309.4, 345

See application file for complete search history.

(56) References Cited

U.S. PATENT DOCUMENTS

| | | | |
|---|---|---|---|
| 2,639,751 | A | 3/1953 | Flaherty et al. |
| 3,324,521 | A | 6/1967 | Humiston |
| 3,372,443 | A | 3/1968 | Daddona |
| 3,454,993 | A | 7/1969 | Jacobson |
| 4,021,891 | A | 5/1977 | Morita |
| 4,453,294 | A | 6/1984 | Morita |
| 4,480,361 | A | 11/1984 | Morita |
| 4,779,314 | A | 10/1988 | Aoki |
| 5,142,746 | A | 9/1992 | Morita |
| 5,152,035 | A | 10/1992 | Morita |
| 5,722,126 | A | 3/1998 | Reiter |
| D404,997 | S | 2/1999 | Podell |
| 5,933,926 | A | 8/1999 | Reiter |
| D438,451 | S | 3/2001 | Reiter |
| D441,639 | S | 5/2001 | Reiter |
| D450,625 | S | 11/2001 | Khromachou |
| D464,562 | S | 10/2002 | Reiter |
| 6,647,597 | B2 | 11/2003 | Reiter |

(Continued)

OTHER PUBLICATIONS http://www.ehow.com/how_7298420_convert-name-badge-magneticfasteners.html.

(Continued)

*Primary Examiner* — Anthony Wiest

(74) *Attorney, Agent, or Firm* — Factor Intellectual Property Law Group, Ltd.

(57) ABSTRACT

A device and a method for attaching a cover to a structure such as a boat. A plurality of complementary configured ferrous and magnetic fasteners is used. The existing fasteners on the boat may be removed or modified to secure the new fasteners. The existing fasteners on the cover may receive a replacement fastener.

6 Claims, 4 Drawing Sheets

(56) References Cited

U.S. PATENT DOCUMENTS

| | | | | |
|---|---|---|---|---|
| 6,836,935 | B2 | 1/2005 | Reiter | |
| 6,892,428 | B2 | 5/2005 | Reiter | |
| 7,640,882 | B2 | 1/2010 | Parniske | |
| 7,913,393 | B2 * | 3/2011 | Royle et al. | 30/50 |
| 8,001,661 | B2 | 8/2011 | Clark | |
| 2010/0050845 | A1 * | 3/2010 | Ipatenco | 83/698.21 |
| 2011/0265289 | A1 | 11/2011 | Wu | |

OTHER PUBLICATIONS http://nb-fcd.en.made-in-china.com/product/EoqmrjRbaGie/China-Professional-Magnetic-Badge-for-Holding-Namecards-2.html.

http://www.yeah-shop.com/buttons-fasterners/122-round-sew-on-leathermagnetic-snap-fastener-3cm.html.

http://www.rnllee.com/storepages/craftworld1.htm.

http://www.etsy.com/search?includes%5B0%5D=tags&q=magnetic+fastener&page=2.

http://www.ehow.com/how_7878484_change-purse-snap.html.

http://www.soyouwanna.com/replace-magnetic-snap-31747.html.

http://craftapple.wordpress.com/2007/08/15/sewing-tip-installing-a-magnetic-snap.

* cited by examiner

DEVICE AND METHOD FOR SECURING A COVER TO A STRUCTURE

CROSS REFERENCE TO RELATED APPLICATIONS

This application claims priority to U.S. Provisional Patent Application No. 61/744,060 filed on Sep. 18, 2012, the entirety of which is incorporated herein by reference.

FIELD OF THE INVENTION

The invention relates to a device and method for securing a cover to a structure, such as a boat, and more particularly to a device and method using magnetic and ferrous fasteners for doing same.

BACKGROUND OF THE INVENTION

When a boat is not in use, a cover is typically secured to the boat to protect certain portions of same from water, the elements (i.e., rain and snow), animals, and other undesired factors (debris, etc.).

In most cases, a boat cover includes a plurality of female snap fasteners ("sockets") which are configured complementary to and which correspond to male snap fasteners ("studs") on the boat. In order to securely fasten the two together, the cover is positioned over the boat, with a female snap fastener positioned over the corresponding male snap fastener, and a force is exerted on the female snap fastener towards the boat. Once enough force has been applied, the female snap fastener is secured, and the next set of fasteners can be secured. Once all of the fastener sets are secured together, the cover is completely secured on the boat.

While such a cover connection device and method are effective for their intended purposes, such a device and method are believed to consume too much time and take too much effort. Specifically, each snap fastener set requires precise positioning and physical energy to secure the fasteners together. Thus, a plurality of such sets would compound the time and energy needed. If, however, a faster and easier method and device existed, less time and energy would be needed to uncover the boat before use and cover the boat after use. Therefore, it is believed that a faster and easier method of attaching and a device for attaching the cover to the boat is desired.

Accordingly, the present invention is directed to providing a device and a method that can provide a sufficiently strong connection between boat and boat cover without taking as much time and/or consuming as much energy.

SUMMARY OF THE INVENTION

While this invention will generally be described with respect to a boat and a boat cover, it should be understood that the present invention can also be used in connection with other structures that utilize removable covers, such as covers for convertible tops on automobiles, storage containers and other open structures that can benefit from removable covers.

In one embodiment of the present invention, the present invention provides a device that includes a first and a second plurality of fasteners. The first plurality contains magnetic fasteners each having an inner surface and an outer surface. The second plurality contains ferrous fasteners each having an inner surface configured complementary to the inner surface of a magnetic fastener from the plurality of magnetic fasteners and an outer surface. The outer surface of each ferrous fastener is configured complementary to a female snap fastener.

In an embodiment, each magnetic fastener has an annular shape and the inner surface includes an aperture. The inner surface of each ferrous fastener may further include a protrusion sized to be received in the aperture of a magnetic fastener. Moreover, the aperture may be disposed at a center of the annular shape.

In yet another embodiment the outer surface of each magnetic fastener is configured complementary to the outer surface of a ferrous fastener.

In still another embodiment, a first magnetic fastener has a first magnetic strength, a second magnetic fastener has a second magnetic strength greater than the first magnetic strength, and a third magnetic fastener has a third magnetic strength greater than the second magnetic strength.

In a further embodiment one of the inner surfaces may be coated with a material to increase friction and/or shear strength.

The plurality of first fasteners may be disposed on a boat and the plurality of second fasteners may be disposed on a boat cover. In order to mount on the boat, each first fastener may include an aperture for receiving a screw.

Certain embodiments of the present invention provide a method of retrofitting a boat to replace existing snap fasteners. The method may include the steps of securing a plurality of first fasteners to a boat proximate locations of existing fasteners on the boat, securing a plurality of second fasteners to a boat cover proximate locations of existing fasteners on the cover, and wherein one of the first fasteners or the second fasteners is magnetic and the other is ferrous.

In some embodiments, the method may include removing at least some of the existing fasteners from the boat prior to securing a plurality of first fasteners to the boat. Alternatively, all of the existing fasteners on the boat may be removed.

In some embodiments of the present invention, the first fasteners are screwed to a boat. The first fasteners may be secured to the existing fasteners of the boat and the second fasteners may be secured to the existing fasteners of the cover. In addition, the first fasteners may be secured to the boat so that each is flush with an outer surface of the boat.

A device according to one or more embodiments is beneficial for a variety of reasons.

The use of the magnetic fasteners is believed to require less time and energy to secure a boat cover—allowing for more enjoyment of a boat. Unlike a transitional snap fastener, the magnetic fasteners will not require precise positioning and extra force exerted to make the secured connection. Thus, the cover can be secured to the boat with less effort and in a shorter amount of time. In addition, in removing the cover, disassociating the magnetic connection is easier than overcoming the snap connection, thus lowering the chance that the cover will tear from overuse.

Moreover, the use of only some magnetic fasteners will lessen the time and energy needed, but will still allow for the use of some snap fasteners if needed. Additionally, or alternatively, various fasteners with varying magnetic strength can be provided to give certain strategically positioned fasteners a greater strength.

In addition, some of the embodiments allow for an existing structure and cover combination to be retrofitted with certain embodiments of the present invention—allowing for the benefits of the present invention to be applied to an existing structure (such as a boat) and cover.

It is to be understood that the aspects and objects of the present invention described above may be combinable and that other advantages and aspects of the present invention will become apparent to those having ordinary skill in the art upon reading the following description of the drawings and the detailed description thereof.

BRIEF DESCRIPTION OF THE DRAWINGS

The present invention will become more fully apparent from the following description and appended claims, taken in conjunction with the accompanying drawings. Understanding that the accompanying drawings depict only typical embodiments, and are, therefore, not to be considered to be limiting of the scope of the present disclosure, the embodiments will be described and explained with specificity and detail in reference to the accompanying drawings as provided below.

DETAILED DESCRIPTION OF THE DRAWINGS

Figure 1:
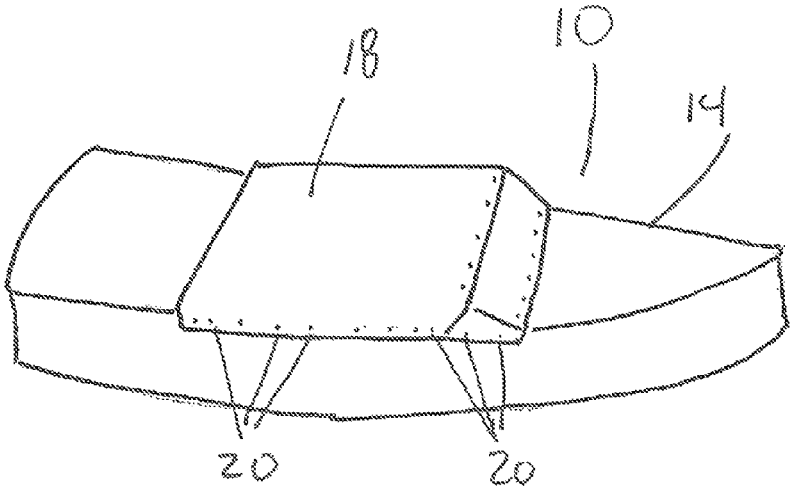
FIG. 1 is a side elevation view of a boat with a cover.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

Reference throughout this description to features, advantages, objects or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, any discussion of the features and advantages, and similar language, throughout this specification may, but does not necessarily, refer to the same embodiment.

Figure 2:
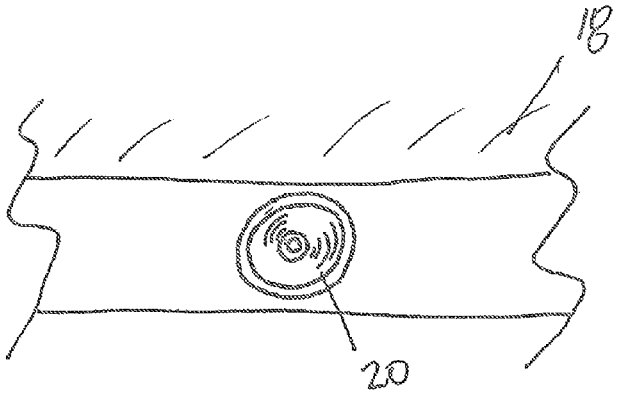
Fig. 2 PRIOR ART
FIG. 2 is a top view of a typical female snap fastener on a boat cover.
Figure 3:
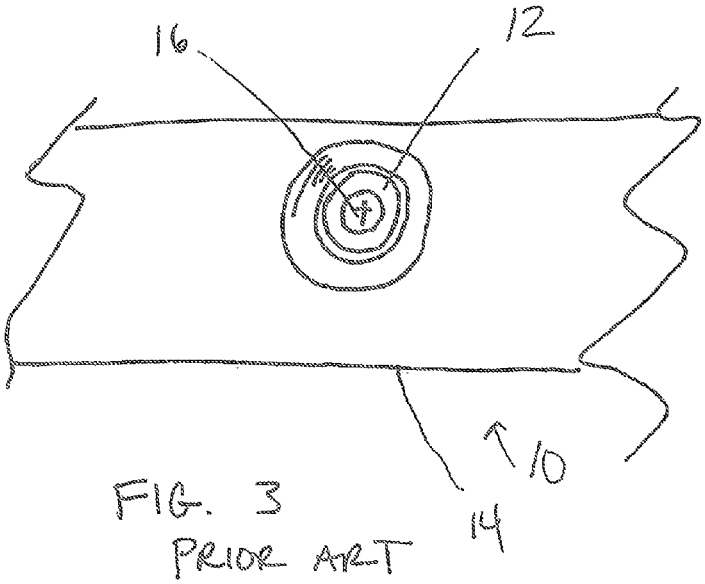
FIG. 3 PRIOR ART
FIG. 3 is a top view of a typical male fastener on a boat.

As mentioned above, the present invention involves a device and method for securing a cover to a structure, such as a boat. As can be seen in FIGS. 1 to 3, boat 10 typically includes a plurality of male snap fasteners 12 secured to outer surface 14 of boat 10—typically secured with screw 16. Boat cover 18 includes a plurality of female snap fasteners 20 secured to cover 18.

Figure 4:
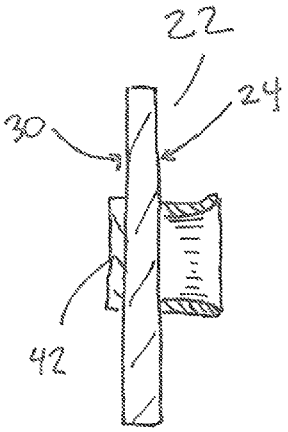
FIG. 4 is a side cutaway of a fastener used in one or more embodiments of the present invention.
Figure 5:
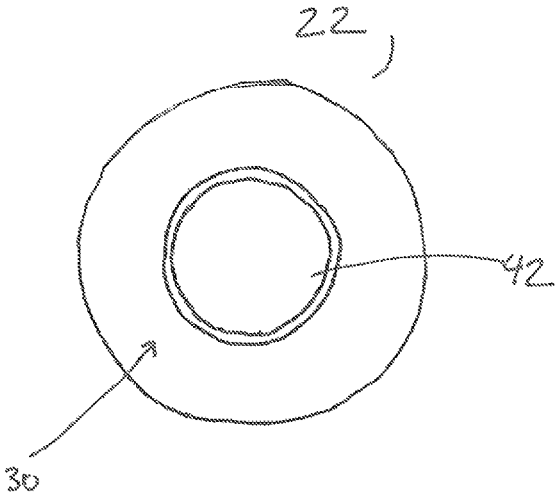
FIG. 5 is a top view of the fastener of FIG. 4.
Figure 6:
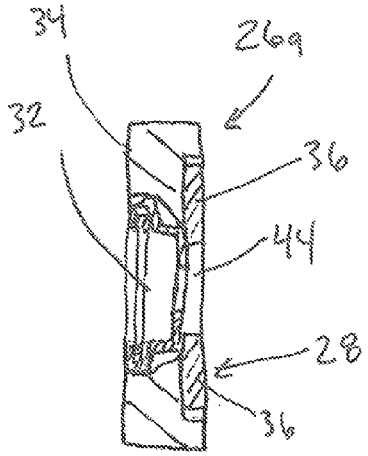
FIG. 6 is a side cutaway of a fastener used in one or more embodiments of the present invention.

Turning to FIGS. 4 and 5, in embodiments of the present invention, the present invention provides a plurality of first fasteners 22. It is preferred that each first fastener 22 is ferrous. By "ferrous" it is meant that the material used will respond to magnetic material, and thus, does not necessarily require that the entirety of first fastener 22 be made of iron. Each first fastener 22 preferably includes outer surface 24 configured to attach to an existing female snap member 20 in cover 18.

As shown in FIGS. 6-9, the present invention also includes a plurality of second fasteners 26*a*, 26*b*. Each second fastener 26*a*, 26*b* comprises magnetic material 36 and includes an inner surface 28 configured complementary to inner surface 30 of first fastener 22.

Figure 7:
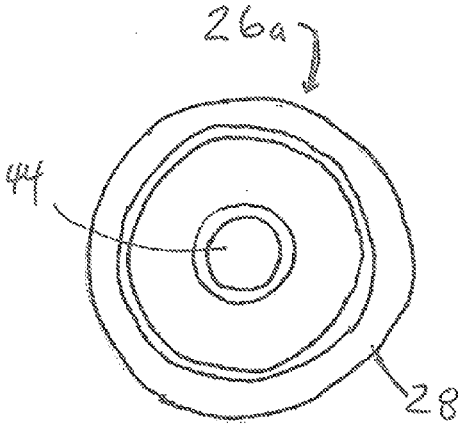
FIG. 7 is a top view of the fastener of FIG. 6.
Figure 8:
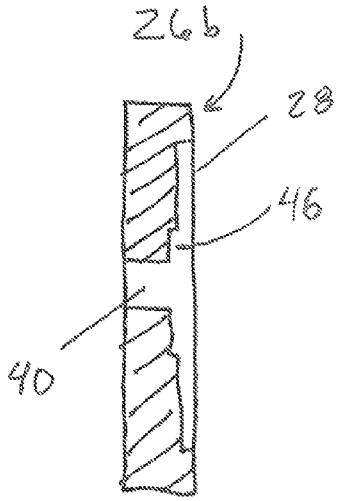
FIG. 8 is a side cutaway of a fastener used in one or more embodiments of the present invention.

Some embodiments of the present invention, as shown in FIGS. 7 and 8, include second fasteners 26*a* that include female snap portion 32 on outer surface 34. The female snap portion 32 may be glued or adhered to magnetic material 36. These second fasteners 26*a* could be secured to boat 10 by merely attaching the female snap portion 32 to an existing male fastener 12 and leaving the second fasteners 26*a* in place on boat 10.

Other embodiments of the present invention include a second fastener 26*b* that is secured to boat 10 with screw 38. In these embodiments, one or more of the existing fasteners 12 on boat 10 may be removed and replaced with second fasteners 26*b*. Accordingly, second fastener 26*b* includes an aperture 40 to receive screw 38 so that second fastener 26*b* can be mounted to boat 10.

It is contemplated that some of the existing fasteners 12, 20 are left in place, at for example, only the corners of boat 10 and cover 18. In other words, if retrofitting a boat (or if installing on a new boat), some sets of the fasteners on boat 10 and cover 18 can be conventional male snap fasteners 12 and female snap fasteners 20 and some sets can be first fasteners 22 and second fasteners 26*a*, 26*b*. It is also contemplated that all of the existing fasteners 12, 20 are removed/replaced with first fasteners 22 and second fasteners 26*a*, 26*b*. Although retrofitting is discussed herein, it is contemplated that the present invention can be used directly with new boats or other such structures that could benefit from at least partial conversion from snap fasteners.

It is contemplated that second fasteners 26*b* may be mounted so that second fasteners 26*b* are flush with outer surface 14 of boat 10. This would minimize any gap between outer surface 14 of boat 10 and cover 18. One way to mount second fastener 26*b* flush would be to countersink second fastener 26*b* by removing a portion of outer surface 14 with a drill. Another method contemplated includes drilling out a larger hole at the location of exiting fastener 12 and securing second fastener 26*b* in same (with, for example, glue/adhesive or a screw).

It is contemplated that a variety of second fasteners 26*a*, 26*b* with different magnetic strengths are provided so that higher strength fasteners can be used at key points to hold cover 18, like the corners, and lower strength magnetic fasteners can be used elsewhere.

The magnetic force between first fasteners 22 and second fasteners 26*a*, 26*b* are believed to be sufficient to hold cover 18 on boat 10. However, in order to improve the securement and provide a faster connection, as shown in FIGS. 4-7, it is contemplated that first fasteners 22 include protrusion 42 and that second fasteners 26*a*, 26*b* include an aperture 44 sized to receive protrusion 42. This self-centering configuration will allow first fasteners 22 and second fasteners 26*a*, 26*b* to obtain a better purchase and make the securement quicker. It is preferred that first fasteners 22 and second fasteners 26*a*, 26*b* have an annular shape and protrusion 42 and aperture 44 are centrally located, respectively—however other geometries are also contemplated.

Figure 9:
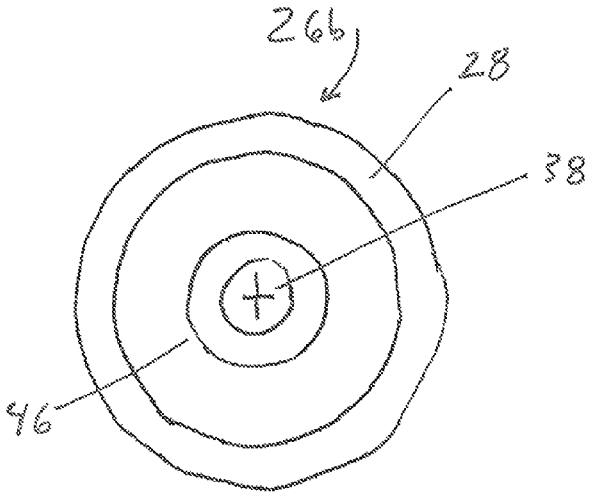
FIG. 9 is a top view of the fastener of FIG. 8.

In addition or alternatively to protrusion 42 and aperture 44, one of the fasteners can be sized to fully receive the other fastener. For example, as shown in FIGS. 8 and 9, second fastener 26*b* includes recess 46 to fully receive first fastener 22.

It is also contemplated that inner surface 28 of second fasteners 26*a*, 26*b* and/or inner surface 30 of first fastener 22 includes a material coating to increase the friction between the two fasteners. Such material may be rubber, nitrile, or other such suitable materials.

Since the fasteners in the embodiments of the present invention utilize a magnetic attachment, a user need not apply force to connect the two complementary configured fasteners. Thus, the time and energy needed to connect cover to boat (or other structure) is minimized.

These and other benefits should be readily apparent to those of ordinary skill in the art.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. A kit for retrofitting magnetic fasteners to an existing boat and boat cover using fasteners to attach the boat cover, the kit comprising:

a plurality of magnetic fasteners each having an annular shape and an inner surface and an outer surface, wherein the outer surface of each magnetic fastener has a female snap portion configured complementary to a male portion of a snap fastener configured on a boat or a boat cover, and the inner surface includes an aperture;

a plurality of ferrous fasteners each having an inner surface and an outer surface, each fastener having an outer surface having a male snap portion configured complementary to a female snap fastener on a boat or a boat cover, and the inner surface includes a protrusion; and, wherein the aperture of the inner surface of each magnetic fastener is configured to receive the protrusion of the inner surface of each ferrous fastener.

2. The kit of claim 1 further comprising a plurality of screw fasteners, wherein, each magnetic fastener includes an aperture and at least one screw fastener is configured to engage the aperture of each magnetic fastener to fix each magnetic fastener to a boat.

3. The kit of claim 1 further comprising a plurality of screw fasteners, wherein, each ferrous fastener includes an aperture and at least one screw fastener is configured to engage the aperture of each ferrous fastener to fix each ferrous fastener to a boat.

4. A kit for retrofitting magnetic fasteners to an existing boat and boat cover using fasteners to attach the boat cover, the kit comprising:

a plurality of magnetic fasteners each having an annular shape and an inner surface and an outer surface, wherein the outer surface of each magnetic fastener has one of a female snap portion configured complementary to a male portion of a snap fastener configured on a boat or a boat cover, or a male snap portion configured complementary to a female portion of a snap fastener configured on a boat or a boat cover, and the inner surface includes an aperture;

a plurality of ferrous fasteners each having an inner surface and an outer surface, wherein the outer surface of each ferrous fastener has one of either a male snap portion configured complementary to a female snap fastener configured on a boat or a boat cover, or a female snap portion configured complementary to a male portion of a snap fastener configured on a boat or a boat cover, and the inner surface includes a protrusion; and, wherein the aperture of the inner surface of each magnetic fastener is configured to receive the protrusion of the inner surface of each ferrous.

5. The kit of claim 4 further comprising a plurality of screw fasteners, wherein, each magnetic fastener includes an aperture and at least one screw fastener is configured to engage the aperture of each magnetic fastener to fix each magnetic fastener to a boat.

6. The kit of claim 4 further comprising a plurality of screw fasteners, wherein, each ferrous fastener includes an aperture and at least one screw fastener is configured to engage the aperture of each ferrous fastener to fix each ferrous fastener to a boat.

* * * * *